US009388982B2

(12) United States Patent
Donais et al.

(10) Patent No.: US 9,388,982 B2
(45) Date of Patent: Jul. 12, 2016

(54) FLOW DEFLECTORS FOR FUEL NOZZLES

(75) Inventors: Richard E. Donais, West Suffield, CT (US); Todd D. Hellewell, Windsor, CT (US); Wendell H. Mills, Austin, TX (US)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 13/281,869

(22) Filed: Oct. 26, 2011

(65) Prior Publication Data

US 2012/0104055 A1 May 3, 2012

Related U.S. Application Data

(60) Provisional application No. 61/407,099, filed on Oct. 27, 2010.

(51) Int. Cl.
*F23D 1/00* (2006.01)

(52) U.S. Cl.
CPC ..... *F23D 1/00* (2013.01); *F23D 2201/20* (2013.01); *F23D 2201/30* (2013.01)

(58) Field of Classification Search
CPC . F23D 2201/20; F23D 2201/30; F23D 17/00; F23D 17/007; F23C 1/06
USPC ..... 110/261, 263, 104 B; 431/284, 169, 431/159; 239/500–524
See application file for complete search history.

(56) References Cited

U.S. PATENT DOCUMENTS 2,956,400 A * 10/1960 Ferri ..... 239/265.39
4,531,461 A 7/1985 Sayler et al.
4,579,525 A * 4/1986 Ross ..... 432/13
4,865,353 A * 9/1989 Osborne ..... 285/16
5,593,302 A * 1/1997 Althaus et al. ..... 431/353
5,829,367 A 11/1998 Ohta et al.
6,024,030 A * 2/2000 Okamoto et al. ..... 110/261
6,089,171 A * 7/2000 Fong et al. ..... 110/263
6,105,516 A * 8/2000 Bowen ..... 110/261
6,116,171 A * 9/2000 Oota et al. ..... 110/263
6,439,136 B1 * 8/2002 Mann et al. ..... 110/263
6,450,396 B1 * 9/2002 Krajewski ..... 228/193
8,104,412 B2 * 1/2012 Zarnescu et al. ..... 110/263
2004/0211345 A1 * 10/2004 Okazaki et al. ..... 110/261
2006/0137456 A1 * 6/2006 Dasgupta et al. ..... 73/705
2007/0125282 A1 * 6/2007 Varagani ..... 110/263
2007/0199196 A1 * 8/2007 Crean ..... 29/897.2
2009/0183693 A1 * 7/2009 Furman ..... 122/16.1
2009/0211502 A1 * 8/2009 Ries ..... 110/263

FOREIGN PATENT DOCUMENTS

EP 2 019 263 1/2009

OTHER PUBLICATIONS

Canadian Examiner's Report dated Aug. 26, 2014 for CA Appln. No. 2,756,421.

* cited by examiner

*Primary Examiner* — Kenneth Rinehart
*Assistant Examiner* — Jason Lau
(74) *Attorney, Agent, or Firm* — ALSTOM Power Inc.

(57) ABSTRACT

A fuel nozzle assembly including a conduit defining a fuel inlet and a fuel outlet and being operable to convey a fuel stream comprising a solid particulate fuel entrained in a fluid. The conduit has a flow area defined by an interior surface of the conduit. A first flow deflector and a second flow deflector extend inwardly from the interior surface. The first flow deflector and the second flow deflector are positioned to disrupt a velocity profile of the flow stream established upstream of the conduit.

30 Claims, 5 Drawing Sheets

FLOW DEFLECTORS FOR FUEL NOZZLES

CROSS-REFERENCE TO RELATED APPLICATIONS

This patent application claims priority benefit under 35 U.S.C. §119(e) of U.S. Provisional Patent Application Ser. No. 61/407,099 filed Oct. 27, 2010, the disclosure of which is incorporated by reference herein in its entirety.

FIELD OF THE INVENTION

The present invention is generally directed to a flow deflector for use in fuel nozzles and is more specifically directed to a flow deflector disposed in or integral with a conduit having a stream of solid fuel particles suspended in a fluid flowing through the conduit.

BACKGROUND OF THE INVENTION

Certain types of furnaces combust small solid fuel particles such as pulverized coal in an interior area defined by the furnace. Typically, the fuel particles are entrained in a stream of fluid or gas, such as air or oxygen, in one or more conduits, such as a pipe. The fuel particles and the air stream are generally referred to as a "fuel stream." The fuel conduits are typically coupled to a generally horizontally mounted nozzle assembly. The nozzle assembly is configured to accelerate the fuel stream therethrough and discharge the fuel stream into the interior area of the furnace. In some instances, the fuel stream enters the nozzle assembly asymmetrically. The asymmetric flow of the fuel stream into the nozzle assembly can create stagnant areas in which fuel particles accumulate into a pile. Typically, the stagnant areas are located at a bottom portion of the nozzle assembly which is adjacent to the inlet thereof. In certain situations, the fuel pile can ignite and burn. Such burning of the fuel pile can lead to uncontrolled overheating resulting in damage to the nozzle assembly and adjacent structures.

SUMMARY OF THE INVENTION

According to aspects disclosed herein, there is provided a fuel nozzle assembly including a conduit defining a fuel inlet and a fuel outlet and being operable to convey a fuel stream comprising a solid particulate fuel entrained in a fluid. The conduit has a flow area defined by an interior surface of the conduit. A first flow deflector and a second flow deflector extend inwardly from the interior surface. The first flow deflector and the second flow deflector are positioned to disrupt a velocity profile of the flow stream established upstream of the conduit.

In one embodiment, opposing portions of the interior surface are spaced apart by a first distance. One end of at least one of the first and second deflectors is spaced away from the fuel inlet by a second distance of up to about 10 percent of the first distance.

One or both of the flow deflectors can have a substantially triangular cross section or other cross sectional shapes. In addition, an abrasive resistant material such as a vacuum bonded aluminum tile may be adhered to exterior surfaces of one or both of the flow deflectors.

According to another aspect defined herein, the conduit defines a first section coupled to a second section which is positioned upstream of the first section. The first and second flow deflectors are positioned in the second section.

In one embodiment, the second section extends from an outlet of an elbow and has a substantially cylindrical cross section. The second section has an interior surface which defines an inside diameter of the second section. One end of one or both of the first and second flow deflectors is spaced away from the outlet of the elbow by a distance of up to about 10 percent of the inside diameter.

In addition, the first and second flow deflectors can be positioned substantially opposite one another and/or substantially symmetrically about a central longitudinal plane defined by the conduit.

The inventors conducted substantial flow modeling and testing to investigate methods for mitigating or eliminating the accumulation of fuel particles in fuel nozzles. Contrary to conventional wisdom, the flow modeling and testing unexpectedly uncovered that the flow stream consisted of two flow fields that wrap around one another in a double helix flow pattern. The flow modeling and testing demonstrated that without the use of flow deflectors, each of the two flow fields contributed to the deposit of fuel particles (e.g., solid particles of a pulverized fuel such as coal) on a bottom portion of the conduit. The flow modeling and testing unexpectedly determined that use of two of the flow deflectors, as described herein and in more detail below, mitigated or prevented fuel particle deposits.

In addition, the flow modeling and testing unexpectedly determined that positioning the flow deflectors generally opposite one another and substantially symmetrical about the central longitudinal plane of the conduit mitigated or prevented the accumulation of fuel particles. The first flow deflector and the second flow deflector cooperate with one another to create turbulence in the flow area. The first flow deflector and the second flow deflector yield the result of precluding fuel particles from accumulating, settling or depositing on the interior surface. Thus, the use of the two flow deflectors, in cooperation with one another, reduces the potential for fires occurring in the fuel nozzle assembly.

BRIEF DESCRIPTION OF FIGURES

With reference now to the figures where all like parts are numbered alike.

DETAILED DESCRIPTION

Figure 1:
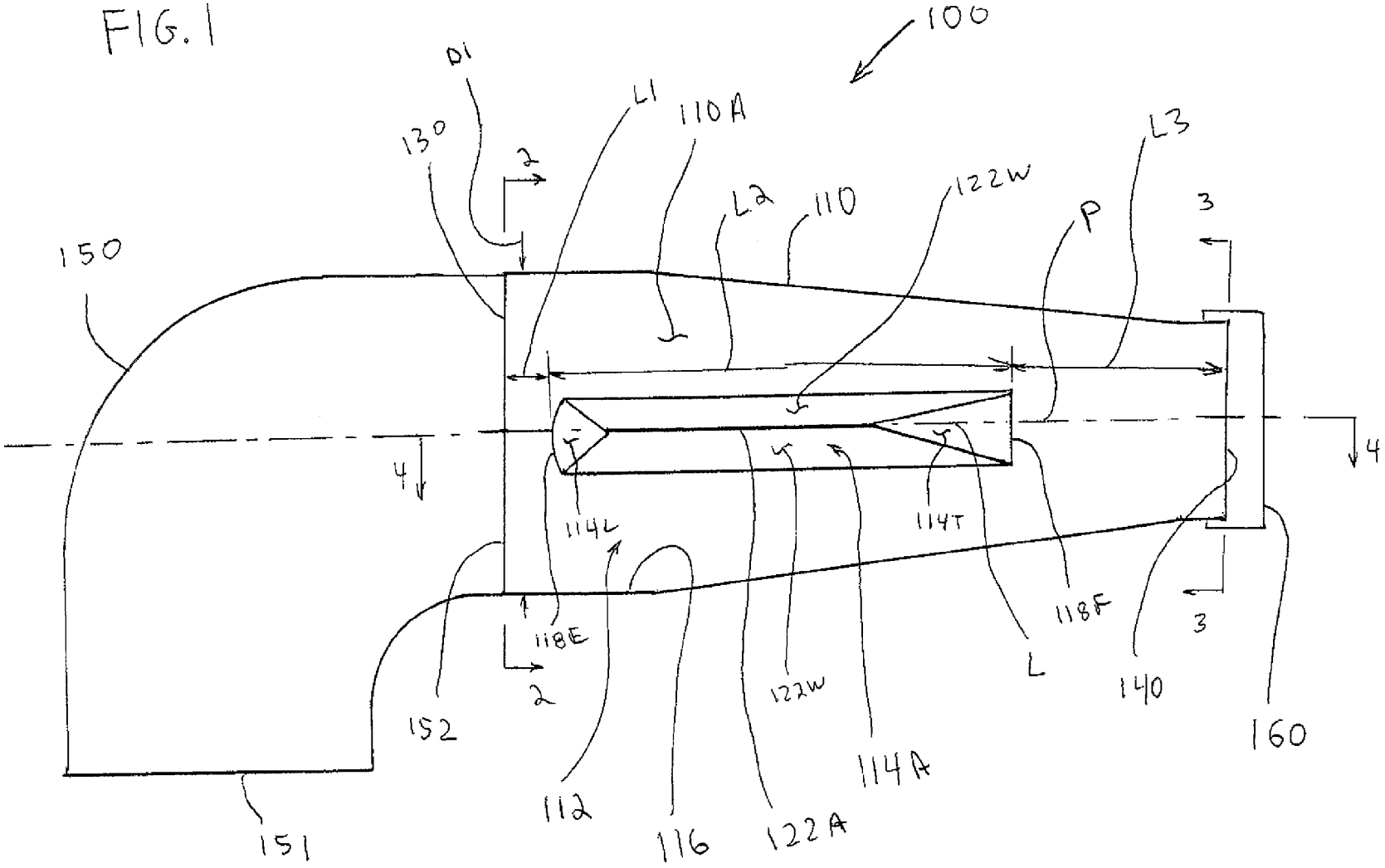
FIG. 1 is a cross sectional side elevation view of a fuel nozzle with flow deflectors positioned therein.

As illustrated in FIGS. 1-4, a fuel nozzle assembly generally designated by the numeral 100 is operable for conveying a fuel stream (e.g., pulverized coal entrained in a stream of air, not shown) therethrough and discharging the fuel stream into an interior area of a furnace (not shown) for combustion therein. The fuel nozzle assembly 100 includes a stationary conduit 110 defining a fuel inlet 130 at one end thereof and a fuel outlet 140 at an opposing end of the conduit 110. An elbow 150 is coupled to the conduit 110 and is in fluid communication with the fuel inlet 130 of the conduit. A discharge tip 160 is moveably positioned on the fuel outlet 140 of the nozzle body 110 for selectively directing the discharge of the fuel stream within the interior area of the furnace. The conduit 110 defines a flow area 112 through which the fuel stream can flow. In the illustrated embodiment, the fuel nozzle assembly 100 includes two flow deflectors 114, namely a first flow deflector 114A and a second flow deflector 114B extending inwardly from an interior surface 110A of the conduit 110 and into the flow area 112. In the illustrated embodiment, the flow deflectors 114 are shown secured to the interior surface 110A with suitable fasteners such as bolts and nuts 115. However, the flow deflectors 114 can be adhered to the interior surface 110A using an adhesive, welded or brazed to the interior surface or can be integral with the conduit, for example, by being formed, cast or molded into the conduit.

The first flow deflector 114A and the second flow deflector 114B are positioned to disrupt a velocity profile of the flow stream established upstream of the conduit, for example, a velocity profile established by positioning and orienting the elbow 150 relative to the conduit 110. The velocity profile exiting the elbow 150 has a double helix configuration that creates stagnant conditions at a bottom portion 116 of the conduit 110 in which fuel particles can accumulate. For example, the double helix velocity profile has an area of greater velocity at an outlet portion of a top portion of the elbow 150. The velocity profile changes as the flow stream travels through portions of the conduit downstream of the elbow 150, splitting into two sub-flow streams. One of the sub-flow streams initiates generally in one upper quadrant of the outlet of the elbow and travels diagonally across and downwardly through the downstream conduit. Another of the sub-flow streams initiates generally in another upper quadrant of the outlet of the elbow and travels diagonally across and downwardly through the downstream conduit. The flow deflectors are positioned to disrupt each of the sub-flow streams. While the flow stream is described as splitting into two sub-flow streams which travel diagonally across and downwardly through the downstream conduit, the present disclosure is not limited in this regard as the flow stream may split into any number of sub-flow streams and any of the sub-flow streams may change directions in the downstream conduit. The flow deflectors 114 are positioned to disrupt the double helix flow velocity profile, and/or the sub-flow streams, to eliminate the stagnant areas and accumulation of fuel particles at the bottom 116 of the conduit.

In the illustrated embodiment, the first flow deflector 114A and the second flow deflector 114B are positioned substantially opposite one another and substantially symmetrical about a central longitudinal plane P defined by the conduit 110. In the illustrated embodiment, the first and second flow deflectors 114A and 114 B are positioned with a longitudinal axis L thereof being coincident with the central longitudinal plane P and in a substantially horizontal configuration.

In addition, the above described velocity profile is dependent upon an orientation of the elbow 150 with respect to the conduit 110. For example, when an inlet of the elbow 150 is substantially vertical, the velocity of the fuel stream is generally greater at a top portion of the inlet 130 of the conduit than the velocity at the bottom portion 116 of the inlet. When the inlet of the elbow 150 is rotated clockwise in a plane parallel inlet 130 of the conduit 110, the velocity of the fuel stream is greater at a section positioned clockwise from the top portion of the inlet 130 than the velocity at a section positioned clockwise of the bottom portion 116 of the inlet. Corresponding changes in the position of the greater and lesser velocities also occur as a result of counterclockwise rotation of the elbow 150. To compensate for the change in position of the greater and lesser velocities, the first flow deflector 114A and second flow deflector 114B can be positioned in the conduit in configurations other than being substantially opposite one another and substantially symmetrical about a central longitudinal plane P defined by the conduit 110. For example, portions of or one or both of the first flow deflector 114A and the second flow deflector 114B may be positioned above or below the horizontal in one or more circumferential positions defined by angles relative to the horizontal, including but not limited to angles, from about 5 degrees below to 5 degrees above the horizontal, from about 10 degrees below to 10 degrees above the horizontal, from about 20 degrees below to 20 degrees above the horizontal, from about 30 degrees below to 30 degrees above the horizontal, and from about 45 degrees below to 45 degrees above the horizontal. In addition, one of the flow deflectors 114 may be positioned above the horizontal and the other of the flow deflectors may be positioned below the horizontal.

Figure 8:
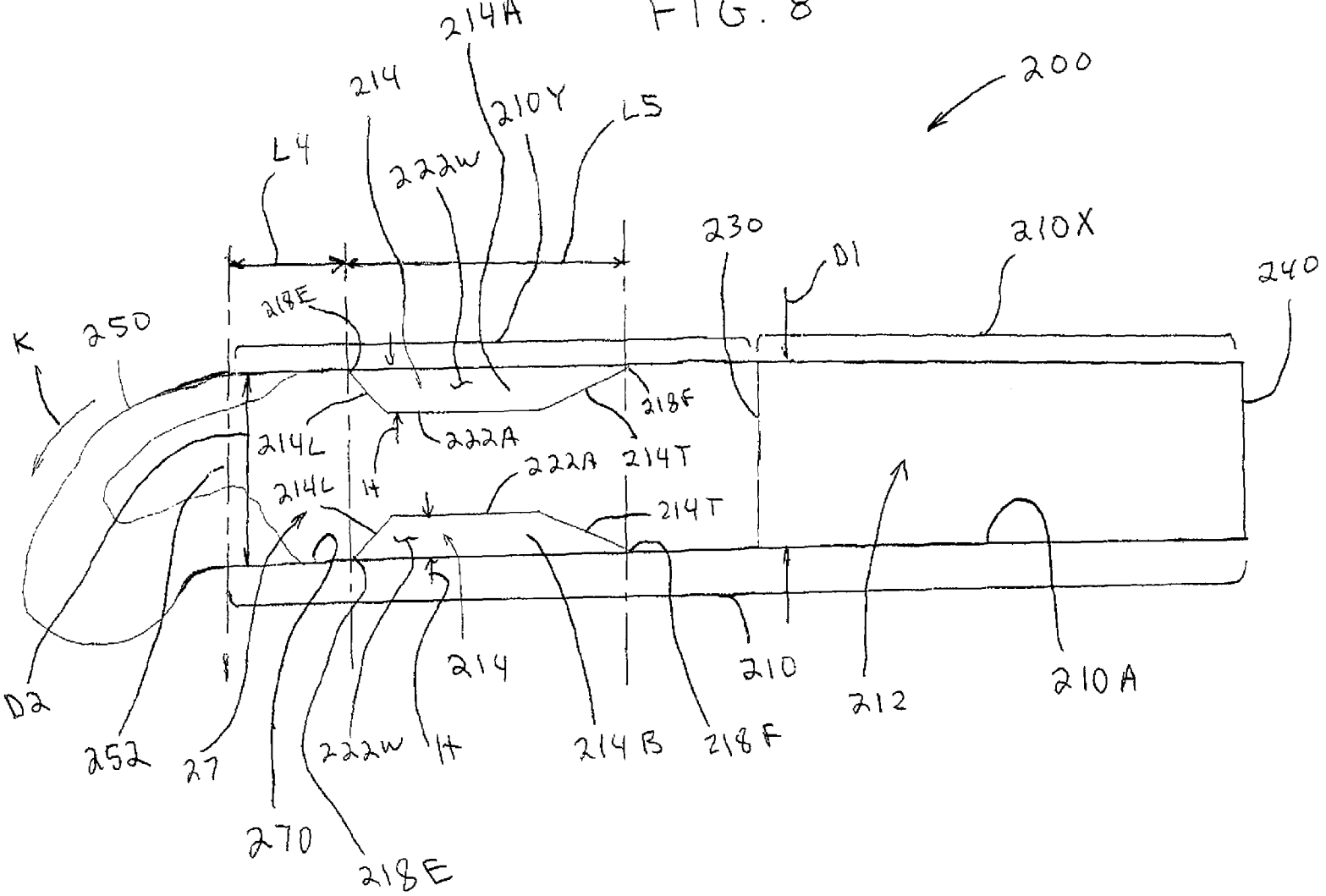
FIG. 8 is a top sectional view of an elbow having flow deflectors positioned in a straight discharge section thereof and taken along a horizontal mid section thereof.

In addition, the longitudinal axis L can be tilted with respect to the horizontal and/or the central longitudinal plane P, for example, by tilting an upstream or downstream end of the flow deflectors 114 either up or down with respect to the horizontal, without departing from the broader aspects disclosed herein. While the fuel nozzle assembly 100 is shown and described as including two flow deflectors 114, the present disclosure is not limited in this regard as the flow deflectors may be disposed in or integral with a conduit positioned upstream of the fuel nozzle assembly, as described below with reference to FIG. 8.

In one embodiment, a portion of the conduit 110 proximate the fuel inlet 130 is substantially cylindrical and tapers and transitions to a rectangular cross section at the fuel outlet 140. Although the conduit 110 is shown and described as being tapered and transitioning from being cylindrical to having a rectangular cross section, the present disclosure is not limited in this regard, as conduits of any cross section may be employed including but not limited to being uniformly or tapered cylindrical, square, rectangular or combinations thereof.

As illustrated in FIGS. 4-7, the flow deflectors 114 each have a base 118 that has a shape complementary to that of the interior surface 110A. For example, as illustrated in FIGS. 1-7 an end 118E of the base 118 proximate the fuel inlet 130 has an arcuate shape (best shown in FIG. 6); and another end 118F of the base 118 proximate the fuel outlet 140 is substantially flat (best shown in FIG. 7). In addition, flow deflectors 114 having bases 118 with shapes complementary to cylindrical, square and/or rectangular cross sections or shapes which are not complementary to the interior surface 110A may also be employed.

Figure 4:
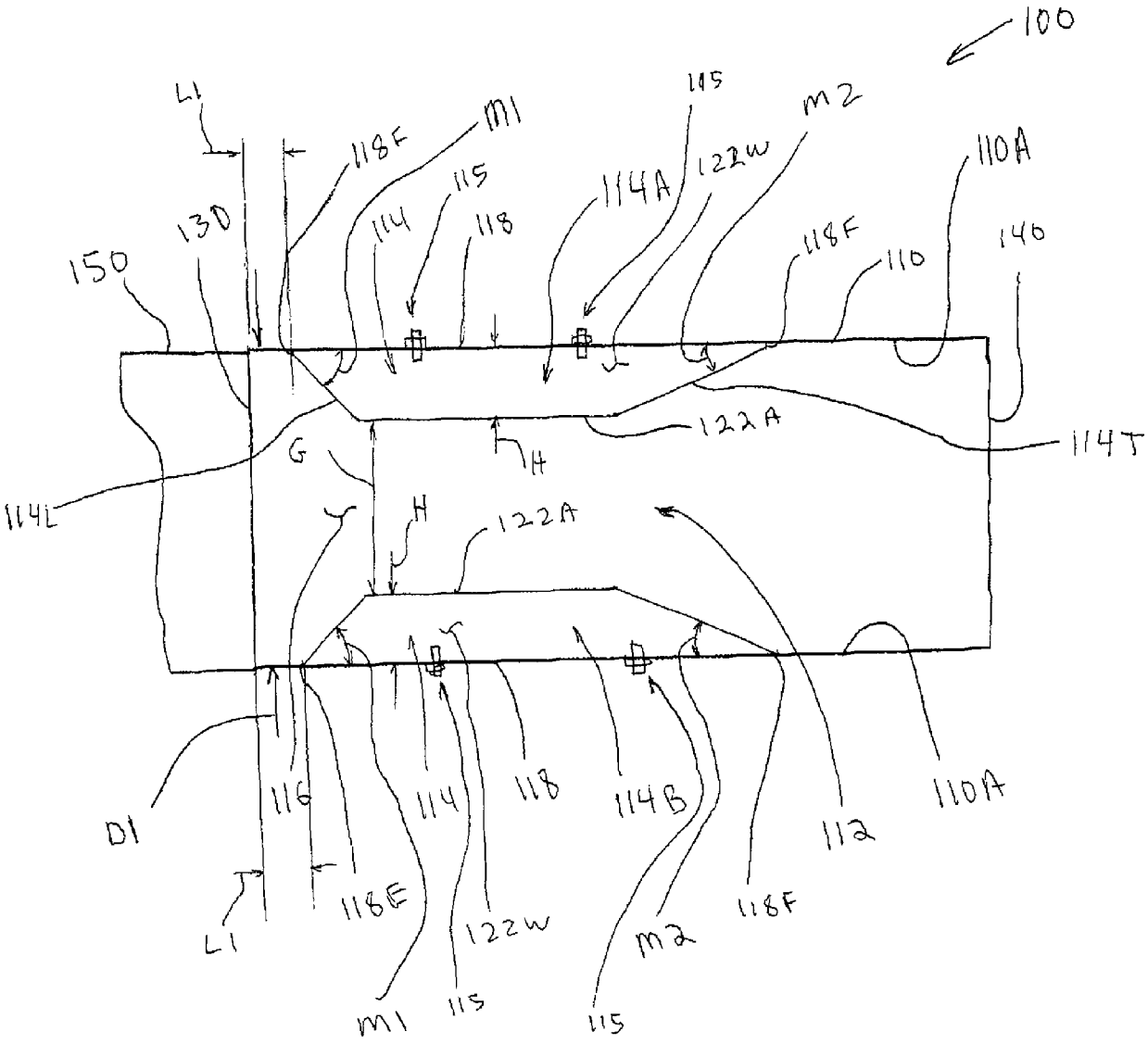
FIG. 4 is a top sectional view of the fuel nozzle of FIG. 1 taken across section 4-4 of FIG. 1.

Referring to FIGS. 1 and 4, the end 118E of the base 118 of each of the flow deflectors 114 is spaced away from the fuel inlet 130 by a distance L1. The magnitude of the distance L1 is less than or equal to about 10 percent of a distance D1, which in the illustrated embodiment, is equal to the inside diameter of the cylindrical portion of the conduit 110. While the distance L1 is shown and described as being less than or equal to about 10 percent of the distance D1, the present disclosure is not limited in this regard as one or both of the flow deflectors 114 may be space away from the fuel inlet by other distances, including but not limited to, L1 being about 2 percent to about 10 percent of the distance D1. Although the distance D1 is shown and described as being equal to the inside diameter of the cylindrical portion of the conduit 110, in the alternative, D1 may be based upon a distance between opposing portions of the interior surface 110A other than the cylindrical portion, such as but not limited to the distance between opposing surfaces of the rectangular portion of the conduit, without deviating from the broader aspects disclosed herein. In addition, although both the first flow deflector 114A and the second flow deflector 114B are shown and described as being spaced away from the fuel inlet 130 by the same distance L1, the present disclosure is not limited in this regard, as the first flow deflector and the second flow deflector can, in the alternative, be spaced away from the fuel inlet by different distances, each within the range of magnitudes of L1 described above.

As illustrated in FIGS. 1-7, the flow deflectors 114 are of an elongated prism shape having a generally triangular cross section defined by two elongated side walls 122W and the base 118. The side walls 122W extend outwardly from an apex 122A. In addition, the side walls 122W terminate at and are joined to the base 118. The apex 122A is substantially coincident with the plane P. The triangular cross section of the flow deflectors 114 is generally perpendicular to respective longitudinal axes L of the flow deflectors. While the flow deflectors 114 are described and shown as being extending from the interior surface 110A and being substantially symmetric about the central plane P, the present disclosure is not limited in this regard as the flow deflectors can be positioned in any orientation in the conduit 110. In addition, the flow deflectors 114 are positioned to interrupt or disrupt the flow stream, portions of the flow stream and/or the downward and/or diagonal flow pattern of the sub-flow streams through the conduit, as described above, to prevent settling of the fuel particles at the bottom 116 of the conduit 110. Although the flow deflectors 114 are shown and described as being substantially prismatic with a triangular cross section, other configurations and cross sections for the first flow deflector 114A and/or the second flow deflector 114B can be employed including but not limited to, non-uniform cross sections, asymmetric cross sections, configurations having concave or convex outer surfaces, and configurations having outer surfaces with protrusions extending therefrom.

The flow deflectors 114 also include two substantially triangular shaped end faces 114L and 114T which slope outwardly from each other and the apex 122A. The end face 114L is positioned proximate the fuel inlet 130 (i.e., on an upstream end of the conduit 110) and slopes away from the inside surface 110A, toward the fuel outlet 140. In one embodiment, the end face 114L is sloped at an angle M1 of about 45 degrees from the inside surface 110A. In another embodiment, the angle M1 is from about 40 degrees to about 50 degrees. In addition, the end face 114T is positioned proximate the fuel outlet 140 (i.e., downstream of the end face 114L) and slopes away from the inside surface 110A, toward the fuel inlet 130. In one embodiment, the end face 114T is sloped at an angle M2 of about 16 degrees from the inside surface 110A. In another embodiment, the angle M2 is from about 10 degrees to about 20 degrees. While each of the flow deflectors 114 is shown and described as having triangular shaped end faces 114L and 114T, the present disclosure is not limited in this regard as one or both of the flow deflectors can have end faces of other shapes and configurations including but not limited to arcuate and rectangular shapes.

Figure 3:
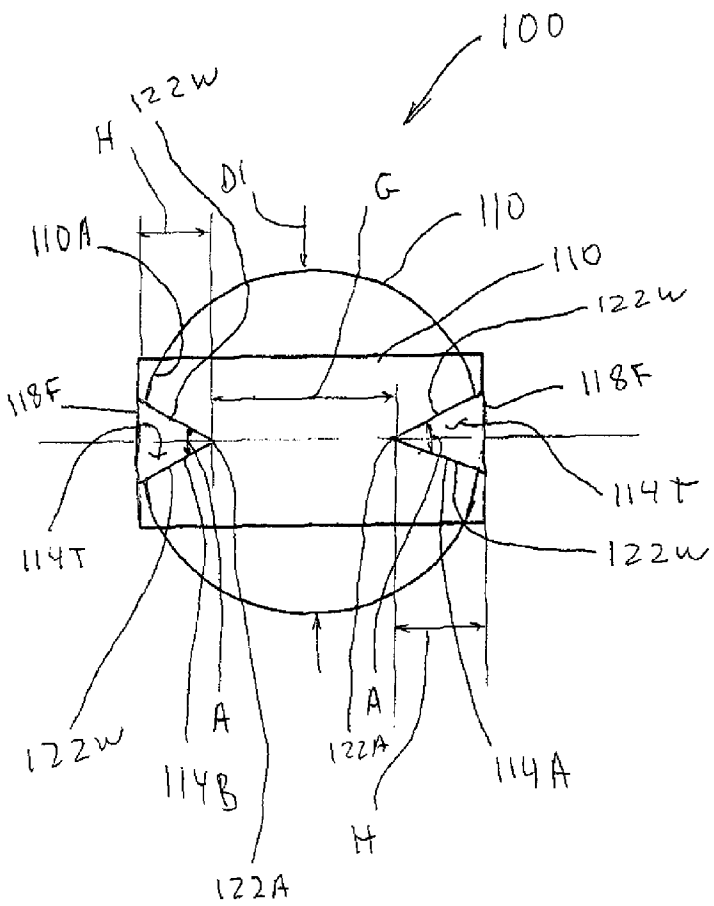
FIG. 3 is a end sectional view of the fuel nozzle of FIG. 1 taken across section 3-3 of FIG. 1.
Figure 2:
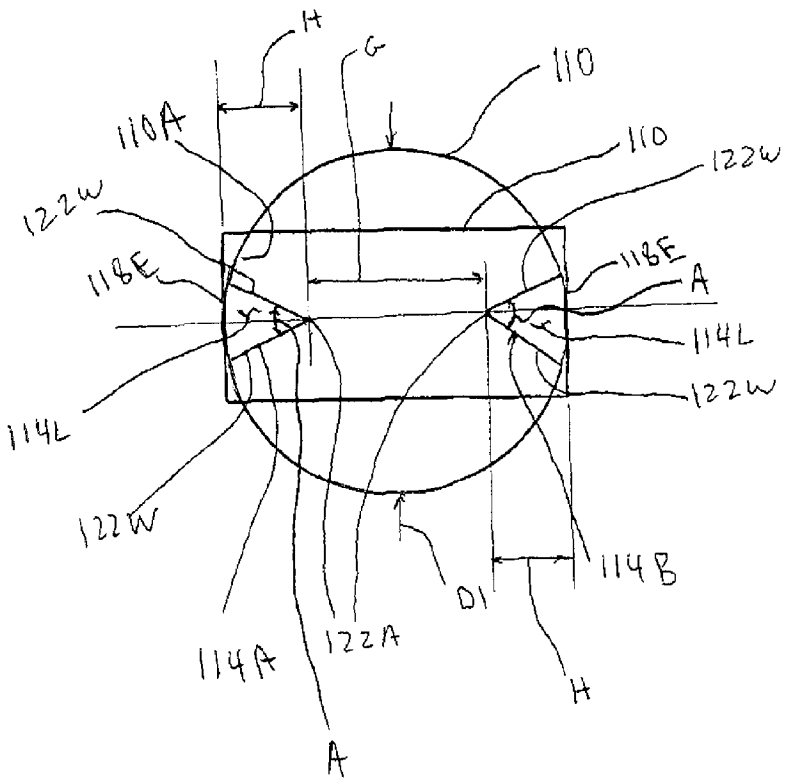
FIG. 2 is a end sectional view of the fuel nozzle of FIG. 1 taken across section 2-2 of FIG. 1.

As illustrated in FIGS. 2-4, each of the flow deflectors 114 have a height H of about 20 to 25 percent of the distance D1. The height H is measured from the apex 122A to the base 118. In one embodiment, the apex 122A of the first flow deflector 114A is spaced apart from the apex 122A of the second flow deflector by a distance G, equal to about 40 percent to about 60 percent of the distance D1. Referring to FIG. 1, the flow deflectors 114 have a length L2 of about 150 percent to about 160 percent of the distance D1. In one embodiment, the side walls 122W extend away from each other by an angle A of about 50 degrees to about 60 degrees. In another embodiment the side walls 122W extend away from each other by an angle A of about 127 degrees. In another embodiment the side walls 122W extend away from each other at an angle A of about 89 degrees. In yet another embodiment, the side walls 122W extend away from each other by an angle A of about 85 degrees to about 130 degrees. Extending the side walls 122W away from one another at the angle A prevents fuel particles from accumulating on the side walls. While each of the flow deflectors 114 are shown and described as having a height H, a length L2 and side walls 122W which extend away from one another at an angle A, the present disclosure is not limited in this regard as the first flow deflector 114A may have a different height, length and/or angle A than that of the second flow deflector 114B.

In one embodiment, the angle A at which the side walls 122W extend away from one another and the configuration of the cross section of the first flow deflector 114A and/or the second flow deflector 114B is selected based upon their position in the conduit relative the central longitudinal plane P and to discourage fuel particles from accumulating on the side walls. For example, when the first flow deflector 114A and/or second flow deflector 114B is positioned in the conduit in a configurations other than being substantially opposite one another and substantially symmetrical about a central longitudinal plane P defined by the conduit 110, an upper facing one of the side walls 122W is configured at an angle relative to the horizontal to prevent accumulation of fuel particles thereon and to encourage the fuel particles to slide off the side wall, inwardly and away from the interior surface 110A.

The end 118F of the base 118 of each of the flow deflectors 114 is positioned a distance L3 from the fuel outlet 140. The magnitude of the distance L3 is about 125 percent of the distance D1. In one embodiment, the magnitude of the distance L3 is about equal to the distance D1 to about 150 percent of the distance D1. Although the base 118 of the flow deflectors 114 are shown and described as being positioned at a length L3 from the fuel outlet 140, the present disclosure is not limited in this regard as the first and second flow deflectors 114A and 114B may be positioned at different distances from the fuel outlet, each within the range of magnitudes of L3 described above.

Figures 5, 6, 7, 9, 10, 11:
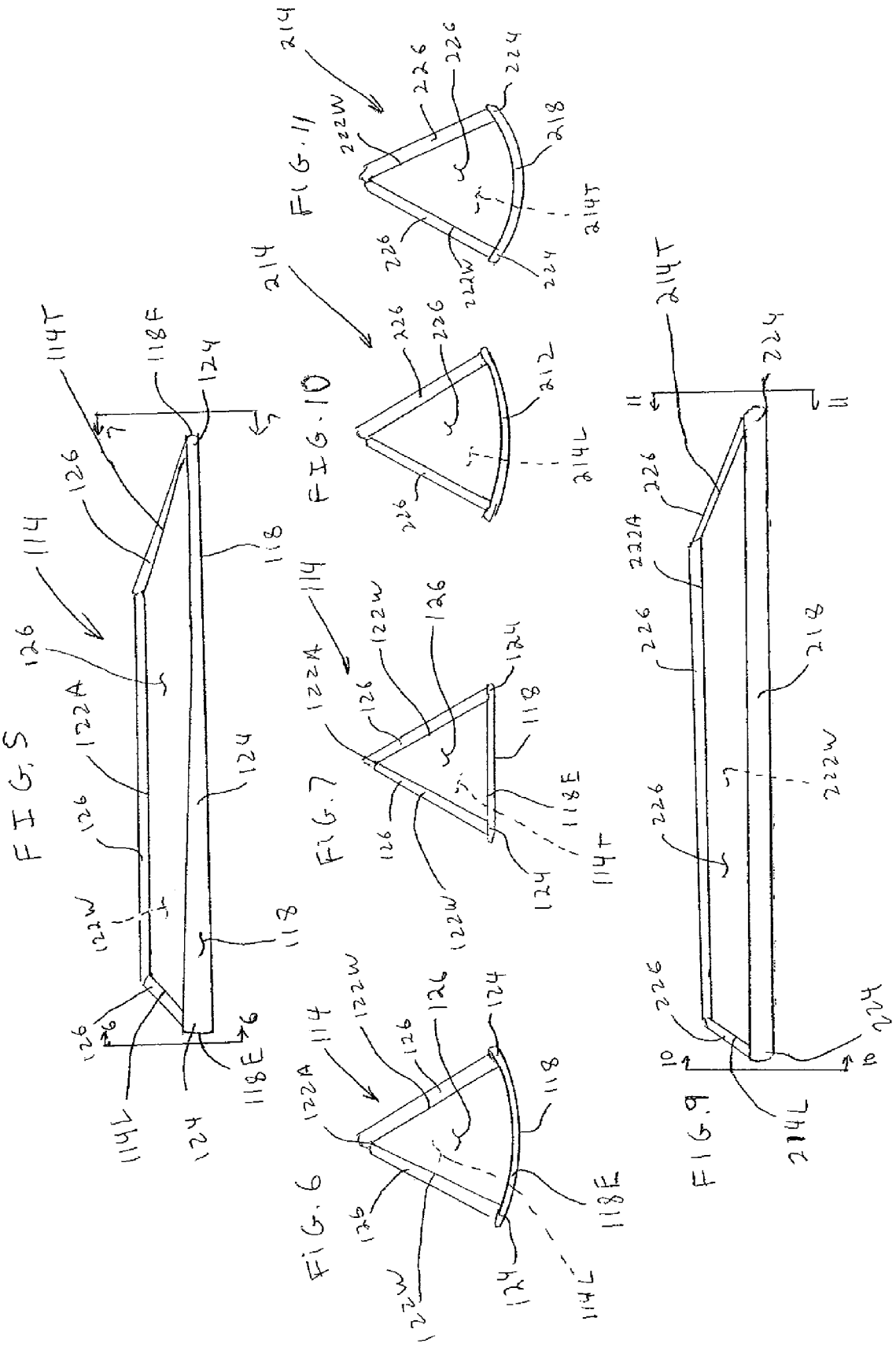
FIG. 5 is a detailed view of one of the flow deflectors of FIG. 4.
FIG. 6 is a end view of the flow deflector of FIG. 5 taken along line 6-6.
FIG. 7 is a end view of the flow deflector of FIG. 5 taken along line 7-7.
FIG. 9 is a detailed view of one of the flow deflectors of FIG. 8.
FIG. 10 is a end view of the flow deflector of FIG. 8 taken along line 10-10.
FIG. 11 is an end view of the flow deflector of FIG. 8 taken along line 11-11.

Referring to FIGS. 5-7, the flow deflectors 114 include a lip 124 which extends from a perimeter of the base 118. The lip 124 provides an area for sealing the base 118 to the interior surface 110A via suitable adhesive, sealant, welding, brazing and/or other suitable devices and methods. In one embodiment, an abrasive resistant covering 126 is secured to the side walls 122W, the end face 114L and the end face 114T. The abrasive resistant covering can be, for example, vacuum bonded aluminum tile. The lip 124 provides a support area for securing the abrasive covering 126 thereto. While the flow deflectors 114 are shown and described as having the lip 124 and the abrasive resistant covering secured thereto, the present disclosure is not limited in this regard as one or both of the flow deflectors 114 can be employed without the lip or the abrasive resistant covering.

In one embodiment, the flow deflectors 114 are substantially hollow prismatic structures formed from one or more metal alloy sheets. While the flow deflectors 114 are described as being substantially hollow, other configurations can also be employed, including but not limited to solid structures and structures that have internal supports secured to interior surfaces of the flow deflectors.

The fuel nozzle assembly 200 of FIGS. 8-11 is similar to the fuel nozzle assembly of FIGS. 1-7. Accordingly, similar elements have been assigned like reference numbers with the first digit (i.e., numeral 1) replaced by the numeral 2. The flow deflectors 214 are configured similar to that described above for the flow deflectors 114. However, the conduit 210 of the fuel nozzle assembly 200 defines a first section 210X coupled to a second section 210Y. The first section 210X is configured similar to the conduit 110. In particular, the first section 210X is substantially cylindrical proximate the fuel inlet 230 and tapers and transitions to a rectangular cross section at the fuel outlet 240. The second section 210Y is substantially cylindrical and has an inside diameter D2 substantially equal to the distance D1 between opposing portions of the interior surface 210A proximate the fuel inlet 230. The second section 210Y is positioned upstream of the first section 210X. In one embodiment, the first section 210X and the second section 210Y are coupled to one another by a flange (not shown). The second section 210Y is integral with and extends from an elbow 250 which is downwardly directed, as illustrated by the arrow K. The elbow 250 is shown with a portion of the exterior surface removed for clarity.

The elbow 250 defines an elbow outlet 252 at cross section where curvature of the elbow terminates and transitions into the substantially straight cylindrical second section 210Y. In another embodiment, the second section 210Y is coupled to the elbow at the outlet 252 by a flange (not shown).

The second section 210Y has an interior surface 270 which defines a flow area 272 through which the fuel stream (e.g., pulverized coal entrained in a stream of air) is conveyed. The fuel nozzle assembly 200 includes two flow deflectors 214, namely a first flow deflector 214A and a second flow deflector 214B secured to the interior surface 270. The flow deflectors 214 are configured similar to the flow deflectors 114 described above however the base 218 has a uniform arcuate shape complimentary to the interior surface 270.

The first flow deflector 214A and the second flow deflector 214B are positioned substantially opposite one another and substantially symmetrical about a central longitudinal plane of the second section 210Y. In one embodiment, the first and second flow deflectors 214A and 214B are positioned with a longitudinal axis thereof in a substantially horizontal configuration.

The end 218E of the base 218 of each of the flow deflectors 214 is spaced away from the elbow outlet 252 by a distance L4. The magnitude of the distance L4 is less than or equal to about 10 percent of the inside diameter D2. In another embodiment, the distance L4 is about 2 percent to about 10 percent of the inside diameter D2. In addition, the flow deflectors 214 have a length L5 of about 110 percent to about 150 percent of D1.

During operation, one or more of the fuel nozzle assemblies 100 is mounted to a furnace (not shown) in a substantially horizontal configuration with a portion of the discharge tip 160 extending into the furnace. Two of the flow deflectors 114 are positioned in the conduit 110 as described above. The fuel stream flows through the elbow 150 and the conduit 110 (i.e., from the fuel inlet 130 to the fuel outlet 140) and is discharged into the furnace through the discharge tip 160. The flow deflectors 114 are operable to create turbulence in the flow area 112 and thereby disrupt the double helix velocity profile exiting the elbow 150. The flow deflectors 114 are operable to preclude fuel particles from settling or depositing on the interior surface 110A. For example, the flow deflectors 114 preclude the accumulation of fuel particles (e.g., solid particles of a pulverized fuel such as coal) on the bottom portion 116 of the interior surface 110A. The flow deflectors 114 reduce or eliminate the accumulation of fuel particles in the conduit 110 which thereby reduces the potential for fires in the conduit.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fuel nozzle assembly comprising:

a conduit defining a fuel inlet and a fuel outlet, operable to convey a fuel stream comprising a solid particulate fuel entrained in a fluid, the conduit having a flow area defined by an interior surface of the conduit, wherein the fuel stream is conveyed to the fuel inlet by an elbow-shaped conduit that results in the fuel stream splitting into at least a first sub-flow fuel stream and a second sub-flow fuel stream diverging from each other concentrated along the interior surface of the conduit;

a first flow deflector extending inwardly from the interior surface of the conduit and longitudinally parallel to a longitudinal axis defining the conduit along the interior surface of the conduit, the first flow deflector having major surface side walls defining the first flow deflector extending longitudinally parallel to the longitudinal axis defining the conduit along the interior surface to disrupt the at least first sub-flow fuel stream to entrain the solid particles back into the fuel stream; and a second flow deflector extending inwardly from the interior surface of the conduit and longitudinally parallel to the longitudinal axis defining the conduit along the interior surface of the conduit, the second flow deflector having major surface side walls defining the second flow deflector extending longitudinally parallel to the longitudinal axis defining the conduit along the interior surface to disrupt the at least second sub-flow fuel stream to entrain the solid particles back into the fuel stream, wherein at least one of the first and second flow deflectors each have substantially triangular cross sections along the longitudinal axis defining the conduit, each having the sidewalls joined at terminal ends thereof defining an apex therebetween.

2. The fuel nozzle assembly of claim 1, wherein a portion of opposing portions of the interior surface of the conduit are spaced apart by a first distance and the upstream end of at least one of the first and second deflectors is spaced away from the fuel inlet by a second distance of up to about 10 percent of the first distance.

3. A fuel nozzle assembly comprising:

a conduit defining a fuel inlet and a fuel outlet, operable to convey a fuel stream comprising a solid particulate fuel entrained in a fluid, the conduit having a flow area defined by an interior surface of the conduit, wherein the fuel stream is conveyed to the fuel inlet by an elbow-shaped conduit that results in the fuel stream splitting into at least a first sub-flow fuel stream and a second sub-flow fuel stream diverging from each other concentrated along the interior surface of the conduit;

a first flow deflector extending inwardly from the interior surface of the conduit and longitudinally parallel to a longitudinal axis defining the conduit along the interior surface of the conduit, the first flow deflector having major surface side walls defining the first flow deflector extending longitudinally parallel to the longitudinal axis defining the conduit along the interior surface to disrupt the at least first sub-flow fuel stream to entrain the solid particles back into the fuel stream; and a second flow deflector extending inwardly from the interior surface of the conduit and longitudinally parallel to the longitudinal axis defining the conduit along the interior surface of the conduit, the second flow deflector having major surface side walls defining the second flow deflector extending longitudinally parallel to the longitudinal axis defining the conduit along the interior surface to disrupt the at least second sub-flow fuel stream to entrain the solid particles back into the fuel stream, wherein at least one of the first and second flow deflectors each have substantially triangular cross sections along the longitudinal axis defining the conduit, each having the sidewalls joined at terminal ends thereof defining an apex therebetween; and wherein the substantially triangular cross sections each reside in a plane that is substantially orthogonal to the longitudinal axis defining the conduit.

4. The fuel nozzle assembly of claim 1, wherein the at least one of the first and second flow deflectors define an end face proximate to the fuel inlet, that slopes away from the inside surface toward the fuel outlet.

5. The fuel nozzle assembly of claim 1, wherein at least one of the first and second flow deflectors define an end face, proximate to the fuel outlet, that slopes away from the inside surface toward the fuel inlet.

6. The fuel nozzle assembly of claim 1, wherein a portion of opposing portions of the interior surface are spaced apart by a first distance and at least one of the first and second flow deflectors define an apex which is positioned outwardly from a base of the respective deflector by a second distance equal to about 20 percent to about 25 percent of the first distance.

7. The fuel nozzle assembly of claim 1, wherein the at least one of the first and second flow deflectors include a lip extending from a perimeter of a base of the respective deflector and wherein the lip is operable to secure the respective flow deflector to the interior surface.

8. The fuel nozzle assembly of claim 1, wherein exterior surfaces of at least one of the first and second flow deflectors have an abrasive resistant material disposed thereon.

9. The fuel nozzle assembly of claim 1, wherein the conduit defines a first section coupled to a second section positioned upstream of the first section and the first and second flow deflectors are positioned in the second section.

10. The fuel nozzle assembly of claim 9, wherein the second section extends from an outlet of an elbow and has a substantially cylindrical cross section defining an inside diameter and one end of at least one of the first and second deflectors is spaced away from the outlet of the elbow by a distance of up to about 10 percent of the inside diameter.

11. The fuel nozzle assembly of claim 10, wherein the second section is integral with the elbow.

12. The fuel nozzle assembly of claim 1, wherein the first and second flow deflectors are positioned substantially opposite one another.

13. The fuel nozzle assembly of claim 1, wherein the first and second flow deflectors are positioned substantially symmetrically about a central longitudinal plane defined by the conduit.

14. The fuel nozzle assembly of claim 1, wherein the side walls of the first and second flow deflectors angle downwardly relative to a central longitudinal plane defined by the conduit to prevent accumulation of fuel particles thereon.

15. The fuel nozzle assembly of claim 1, wherein a portion of opposing portions of the interior surface are spaced apart by a first distance and at least one of the first and second flow deflectors have a longitudinal length of about 150% to 160% of the first distance.

16. The fuel nozzle assembly of claim 1, wherein the first flow deflector and second flow deflector are disposed above or below a central longitudinal plane defined by the conduit.

17. The fuel nozzle assembly of claim 3, wherein a portion of opposing portions of the interior surface of the conduit are spaced apart by a first distance and the upstream end of at least one of the first and second deflectors is spaced away from the fuel inlet by a second distance of up to about 10 percent of the first distance.

18. The fuel nozzle assembly of claim 3, wherein the at least one of the first and second flow deflectors define an end face proximate to the fuel inlet, that slopes away from the inside surface toward the fuel outlet.

19. The fuel nozzle assembly of claim 3, wherein at least one of the first and second flow deflectors define an end face, proximate to the fuel outlet, that slopes away from the inside surface toward the fuel inlet.

20. The fuel nozzle assembly of claim 3, wherein a portion of opposing portions of the interior surface are spaced apart by a first distance and at least one of the first and second flow deflectors define an apex which is positioned outwardly from a base of the respective deflector by a second distance equal to about 20 percent to about 25 percent of the first distance.

21. The fuel nozzle assembly of claim 3, wherein the at least one of the first and second flow deflectors include a lip extending from a perimeter of a base of the respective deflector and wherein the lip is operable to secure the respective flow deflector to the interior surface.

22. The fuel nozzle assembly of claim 3, wherein exterior surfaces of at least one of the first and second flow deflectors have an abrasive resistant material disposed thereon.

23. The fuel nozzle assembly of claim 3, wherein the conduit defines a first section coupled to a second section positioned upstream of the first section and the first and second flow deflectors are positioned in the second section.

24. The fuel nozzle assembly of claim 23, wherein the second section extends from an outlet of an elbow and has a substantially cylindrical cross section defining an inside diameter and one end of at least one of the first and second deflectors is spaced away from the outlet of the elbow by a distance of up to about 10 percent of the inside diameter.

25. The fuel nozzle assembly of claim 24, wherein the second section is integral with the elbow.

26. The fuel nozzle assembly of claim 3, wherein the first and second flow deflectors are positioned substantially opposite one another.

27. The fuel nozzle assembly of claim 3, wherein the first and second flow deflectors are positioned substantially symmetrically about a central longitudinal plane defined by the conduit.

28. The fuel nozzle assembly of claim 3, wherein the side walls of the first and second flow deflectors angle downwardly relative to a central longitudinal plane defined by the conduit to prevent accumulation of fuel particles thereon.

29. The fuel nozzle assembly of claim 3, wherein a portion of opposing portions of the interior surface are spaced apart by a first distance and at least one of the first and second flow deflectors have a longitudinal length of about 150% to 160% of the first distance.

30. The fuel nozzle assembly of claim 3, wherein the first flow deflector and second flow deflector are disposed above or below a central longitudinal plane defined by the conduit.

* * * * *